United States Patent [19]

Petitto, Sr. et al.

[11] Patent Number: 4,799,850

[45] Date of Patent: Jan. 24, 1989

[54] MATERIAL HANDLING VEHICLE FOR USE IN A MINE

[75] Inventors: Angelo S. Petitto, Sr.; Angelo A. Petitto; James L. Petitto, all of Morgantown, W. Va.

[73] Assignee: Petitto Mine Equipment, Inc., Morgantown, W. Va.

[21] Appl. No.: 128,336

[22] Filed: Dec. 3, 1987

[51] Int. Cl.[4] ..... B60P 1/54

[52] U.S. Cl. ..... 414/687; 414/728

[58] Field of Search ..... 414/687, 719, 728, 718, 414/744 R

[56] References Cited

U.S. PATENT DOCUMENTS

| | | | |
|---|---|---|---|
| 2,949,201 | 8/1960 | MacAlpine et al. | 414/625 |
| 4,199,299 | 4/1980 | Petitto, Sr. et al. | 414/718 |
| 4,225,282 | 9/1980 | Nordstrom et al. | 414/694 |

*Primary Examiner*—Robert J. Spar
*Assistant Examiner*—Donald W. Underwood
*Attorney, Agent, or Firm*—Stanley J. Price, Jr.

[57] ABSTRACT

A self-propelled vehicle maneuverable in an underground mine includes an elongated body having a forward end portion with a boom assembly mounted thereon. The boom assembly includes a pair of boom members that are telescopically arranged to vary the overall length of the boom. A material handling device is secured to the end portion of the boom assembly and is operable to perform various material handling operations in the mine. A support arrangement secures the boom assembly to the front of the vehicle. A pair of double acting piston cylinder assemblies are mounted on the mobile body and are connected to the support arrangement for laterally swinging the boom assembly relative to the elongated body. The boom assembly is also connected to the support arrangement for upward and downward pivotal movement independently of the lateral swinging movement by operation of a pair of pivoting cylinders. The pair of pivoting cylinders are positioned laterally of a longitudinal axis of the boom assembly and are connected to the support arrangement and to the sides of the boom assembly. With this arrangement the boom assembly is extensible and movable laterally and vertically to position the material handling device at a preselected position relative to the vehicle.

8 Claims, 3 Drawing Sheets

MATERIAL HANDLING VEHICLE FOR USE IN A MINE

BACKGROUND OF THE INVENTION

1. Field of the Invention

This invention relates to a material handling vehicle, and more particularly, to a self-propelled mine vehicle having a telescoping boom member secured to the front of the vehicle that is operable to position a material handling device secured to the end of the boom member at a preselected lateral and vertical position for performing material handling operations in a mine.

2. Description of the Prior Art

In underground mining operations it is well known to move equipment and materials into and out of the mine by methods which utilize devices such as chains, pulleys, hoists and the like. In the assembly and disassembly of long wall mining systems, various components suchs as pans, cribbing, roof supports and conveyers must be transported into the mine entry and maneuvered into position adjacent the mine face. The utilization of devices such as chains, pulleys and hoists to maneuver these components requires the coordinated efforts of mine personnel, and precautions must be taken in coordinating these movements in order to prevent serious injury. Due to the disadvantages of conventional known material handling devices and methods that are utilized in the mine, serious injuries to mine personnel have occured while moving equipment even though every available safety precaution had been taken.

In an attempt to eliminate the hazards involved in transporting and maneuvering material in a mine, various devices have been utilized.

U.S. Pat. No. 2,949,201 discles an excavator or mucking machine having a bucket positioned on the end of an arm. The arm is a telescoping boom type which may be swung laterally relative to the mucking machine body. The mucking machine is operable to collect material and move it to a point of discharge without the assistance of mine personnel.

U.S. Pat. No. 3,061,122 discloses apparatus which may be used to move loose material such as rock, earth and the like, and also may be used to move bulk cargo. The apparatus includes an excavating device secured to a vertical mast, and the excavating device may be pivoted vertically and laterally to move material from one location to another.

U.S. Pat. No. 3,226,857 discloses a vehicle for loading, transporting and unloading cargo. The vehicle includes a mobile body with an open scoop adapted to receive bulk cargo pivotally secured thereto.

U.S. Pat. No. 4,199,299 discloses a self-propelled vehicle maneuverable in an underground mine which includes a mobile body having a telescoping boom assembly mounted thereon. The boom assembly carries at its outer end a material engaging device. The boom assembly may be swung laterally and vertically to place the material engaging device at a preselected location relative to the mobile body.

Other self-propelled vehicles are also available for transporting and maneuvering material within a mine. One such vehicle includes a mobile body with a boom assembly mounted thereon. A single cylinder connected between the mobile body and the underside of the boom assembly is operable to pivot the boom assembly vertically. The vehicle also includes a pair of cylinders connected to the boom assembly and to the mobile body for pivoting the boom assembly laterally relative to the mobile body.

While these prior art devices are all operable to transport material from one location to another within a mine, the size and weight of various components of presently used long wall mining systems and other components used in a mine have increased over those previously used. Therefore, there is a need for an improved material handling vehicle that is self-propelled and maneuverable in a mine to safely and efficiently perform a wide variety of equipment handling operations without requiring the assistance of mine personnel.

SUMMARY OF THE INVENTION

In accordance with the present invention there is provided a material handling vehicle for use in an underground mine that includes a mobile body and ground engaging traction means connected to the mobile body for propelling the body in a mine along the mine floor. A boom assembly extends from the mobile body and has a first end portion adjacent the mobile body and a second end portion spaced from the first end portion. A support post is secured to the mobile body and extends upwardly therefrom. A tubular member is positioned in surrounding relation with the support post and is rotatably secured thereto. The boom assembly first end portion is connected for vertical pivotal movement to the tubular member. A first actuating device is mounted on the mobile body and is connected to the tubular member to permit rotation of the tubular member relative to the support post. With this arrangement, rotation of the tubular member relative to the support post permits lateral swinging movement of the boom assembly on the mobile body. A second actuating device, in the form of a pair of pivoting cylinders, are positioned on each side of the boom assembly and connected between the tubular member and the boom assembly. The pair of pivoting cylinders are operable to pivot the boom assembly in a vertical path relative to the tubular member. With this arrangement the boom assembly is capable of being pivoted vertically independently of the lateral movement of the boom assembly on the mobile body. An extensible means is provided for extending and retracting the boom assembly second end portion relative to the boom assembly first end portion so that the overall length of the boom assembly may be varied to suit a particular material handling operation.

Material engaging means is connected to the boom assembly second end portion for engaging material to be lifted and moved by the boom assembly. Since the boom assembly may be pivoted laterally and also raised or lowered vertically relative to the mobile body, the material engaging means connected to the boom assembly second end portion may be positioned as required to facilitate connection with a piece of equipment to be moved.

Accordingly, the principle object of the present invention is to provide a material handling vehicle operable in underground mining operations having a boom assembly that may be positioned for upward, downward and lateral swinging movement on a mobile body to facilitate efficient handling of material in an underground mine.

Another object of the present invention is to provide a material handling vehicle having a boom assembly connected to the vehicle body by a support arrangement having a configuration to permit a pair of lifting cylinders to be connected between the boom assembly and the support apparatus to facilitate vertical pivotal movement of the boom assembly when the boom assembly is connected to a heavy load.

These and other objects of the present invention will be more completely disclosed and described in the following specification, the accompanying drawings and the appended claims.

BREIF DESCRIPTION OF THE DRAWINGS

DESCRIPTION OF THE PREFERRED EMBODIMENTS

Figure 1:
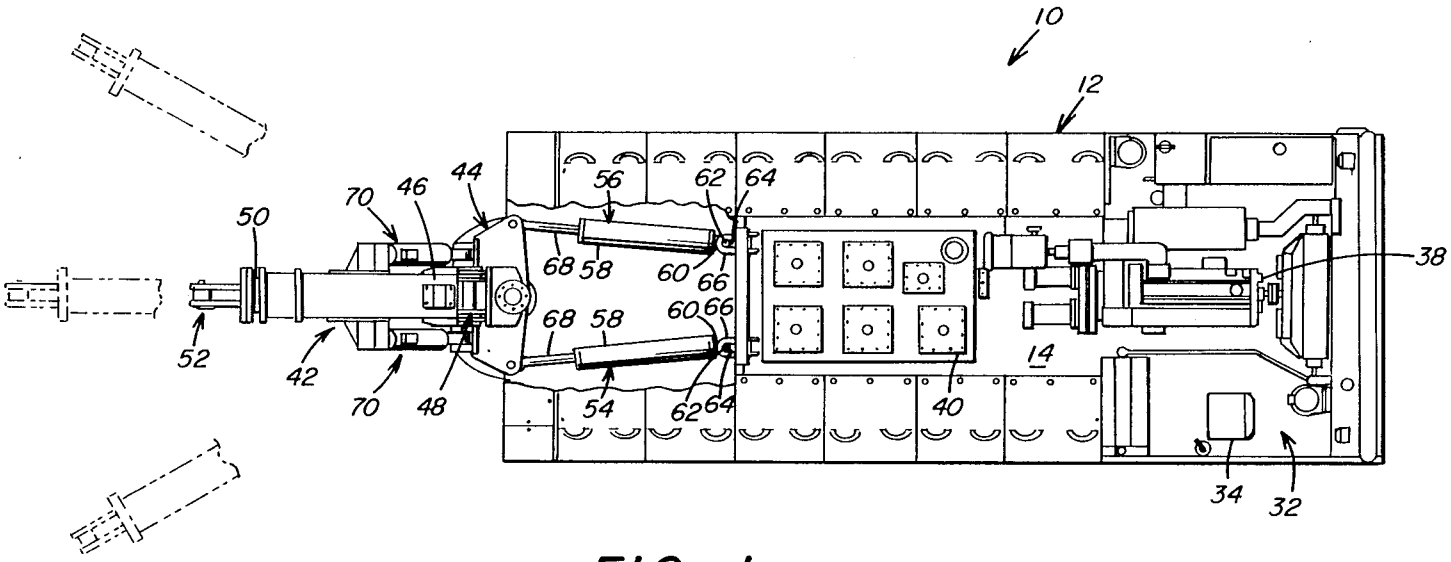
FIG. 1 is a top plan view of a material handling vehicle for use in a mine, illustrating a telescoping boom assembly having a material engaging device secured to the end portion thereof, and illustrating in phantom the boom assembly pivoted laterally relative to the vehicle body.
Figure 2:
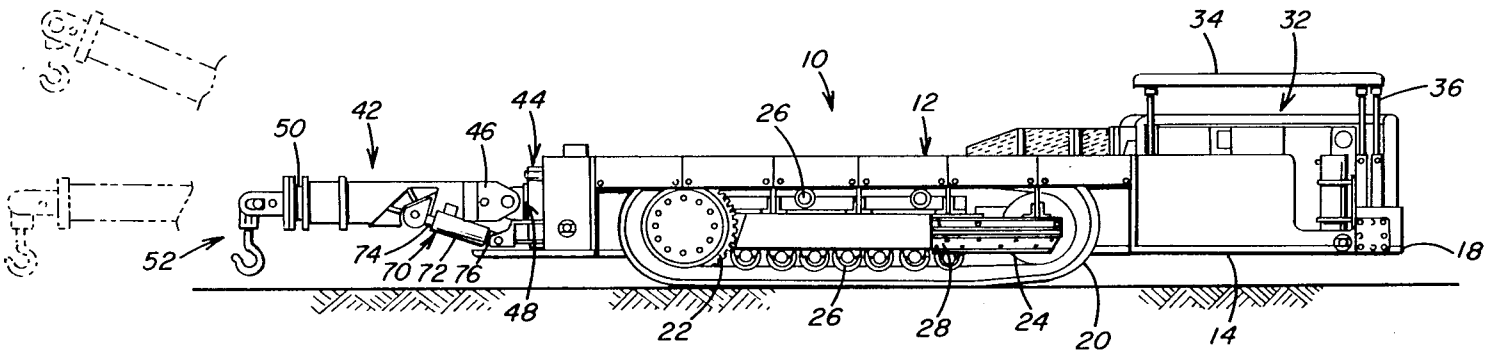
FIG. 2 is a view in side elevation of the material handling vehicle of FIG. 1 illustrating the boom assembly in a retracted position and extending forwardly of the vehicle body, and illustrating in phantom the boom assembly pivoted vertically relative to the vehicle body.

Referring to the drawings, and particularly to FIGS. 1 and 2, there is illustrated a material handling vehicle generally designated by the numeral 10 for use in underground mining operations or in any type of underground excavation work. The material handling vehicle 10 includes a mobile body portion 12 having a longitudinally extending frame 14. The frame 14 has a front end 16 and a rearward end 18. The frame 14 of the mobile body 12 is mounted on a pair of ground engaging traction devices 20 (one shown), such as a pair of propelling endless tracks. Each of the endless tracks 20 is reeved about a drive sprocket 22 and an idler sprocket 24, and supported by idler rollers 26 connected to a frame 28 that extends between and is connected to the sprockets 22 and 24. The idler rollers 26 support the upper and lower reaches of the endless track 20 as it turns in a preselected direction upon rotation of drive sprocket 22.

The drive sprocket 22 for each endless track 20 is drivingly connected, in a manner not shown, to a suitable motor/gearbox unit to permit rotation of drive sprocket 22 in a preselected direction. As known in the art, rotation of the drive sprockets 22 in a preselected direction move the endless tracks 20 in the same direction to permit either forward or rearward advancement of the mining vehicle 10.

The material handling vehicle 10 includes an operators station generally designated by the numeral 32. The operators station includes an overhead canopy 34 that may be raised and lowered by piston cylinder assemblies 36 to accommodate the overhead clearance provided between the top of the vehicle 10 and the mine roof. Operators station 32 is provided with controls for propelling and steering material handling vehicle 10, as well as for carrying out the material handling operations performed by the vehicle 10 in accordance with the present invention.

The material handling vehicle 10 includes a prime mover 38, such as a diesel engine, which is secured to the vehicle frame 14. The operation of diesel engine 38 is itself known in the art, and is described herein only as it pertains to the present invention. The diesel engine 38 is employed to operate fluid pumps that supply fluid under pressure to various fluid operated devices on the vehicle 10, such as the fluid actuated piston cylinder assemblies provided on mobile body 12 which will be described later in greater detail. The fluid pumps supply fluid, such as hydraulic oil, from a tank 40 mounted on the frame 14 through conventional hydraulic conduits (not shown) to the various fluid operated devices. The controls for suppling fluid to the fluid operated devices are located at operators station 32, together with the controls by which the speed and the direction of movement of the vehicle 10 are controlled.

A telescoping boom assembly, generally designated by the numeral 42, extends forwardly of the front end 16 of frame 14 and is supported thereon by a support arrangement generally designated by the numeral 44. The boom assembly 42 includes a first end portion 46 that is secured to support arrangement 44 by connecting apparatus generally designated by the numeral 48 in a manner to facilitate upward and downward movement of the entire boom assembly 42. A second end portion 50 of boom assembly 42 is extensible out of and into the boom assembly first end portion 46 and includes at its outer end portion a material engaging device generally designated by the numeral 52. Material engaging device 52 is utilized to perform a number of material handling operations encountered within a mine.

In order to position material engaging device 52 at a preselected location to perform a desired material handling operation, the material engaging device 52 is moved by boom assembly 42 relative to mobile body 12. Lateral movement of the boom assembly 42 is accomplished through the support arrangement 44 by operation of a pair of fluid actuated devices, such as piston cylinder assemblies 54 and 56 illustrated in FIGS. 1 and 3. Each of the piston cylinder assemblies 54, 56 includes a cylinder body portion 58. Each cylinder body portion 58 includes a connecting end portion 60 with a lug 62 extending upwardly therefrom. The lug 62 is arranged to be received within a longitudinal slot 64 of a bracket member 66. The bracket member 66 is securely mounted to the vehicle frame 14. This arrangement permits pivotal movement of the cylinder body portion 58 during operation. The opposite end portion of each of the assemblies 54, 56 includes a piston rod 68 that is secured at its outer end portion to support arrangement 44.

The piston cylinder assemblies 54, 56 are operable together to effect lateral swinging movement of boom assembly 42 at the front end 16 of frame 14. Thus, in a manner to be explained further in greater detail, to swing the boom assembly 42 laterally in a clockwise direction on the frame 14, assembly 54 is actuated to extend its piston rod 68 from the cylinder body 58; while the piston rod 68 associated with piston cylinder assembly 56 is retracted into the cylinder body 58. Preferably, a single control is operable to effect the coordinated extension and retraction of the piston rods of the assemblies 54, 56. Conversely, to swing the boom assembly 42 laterally in a counter-clockwise direction the piston rod 68 of assembly 56 is extended and the piston rod 68 of assembly 54 is simultaneously retracted.

Independently of the lateral swinging movement of boom assembly 42, the boom assembly 42 is also operable to move upwardly and downwardly to position the material engaging device 52 at a preselected elevation relative to the frame 14 or relative to the mine floor and roof. As seen in FIGS. 1 and 2, upward and downward movement of boom assembly 42 is accomplished by a pair of fluid actuated devices, such as a pair of cylinder assemblies 70 each having a cylinder body 72 and a piston rod 74 movable into and out of cylinder body 72. As seen in FIG. 2, a cylinder 70 is positioned longitudinally at each side of boom assembly 42. The cylinder bodies 72 are pivotally connected at their respective end portions 76 to support arrangement 44. The outer end of each piston rod 74 is connected to boom assembly 42. With this arrangement, extension and retraction of the pair of piston rods 74 pivots boom assembly 42 and material engaging device 52 upwardly and downwardly as the end portion of the boom assembly 42 adjacent support arrangement 44 pivots about the connection between boom assembly 42 and support arrangement 44. Due to the increased size and weight of various components presently used in long wall mining systems and other equipment used in a mine, utilizing a pair of hydraulically actuated cylinders positioned longitudinally of boom assembly 42 provides the boom assembly lifting power required to safely and efficiently lift and maneuver these pieces of equipment.

Figure 3:
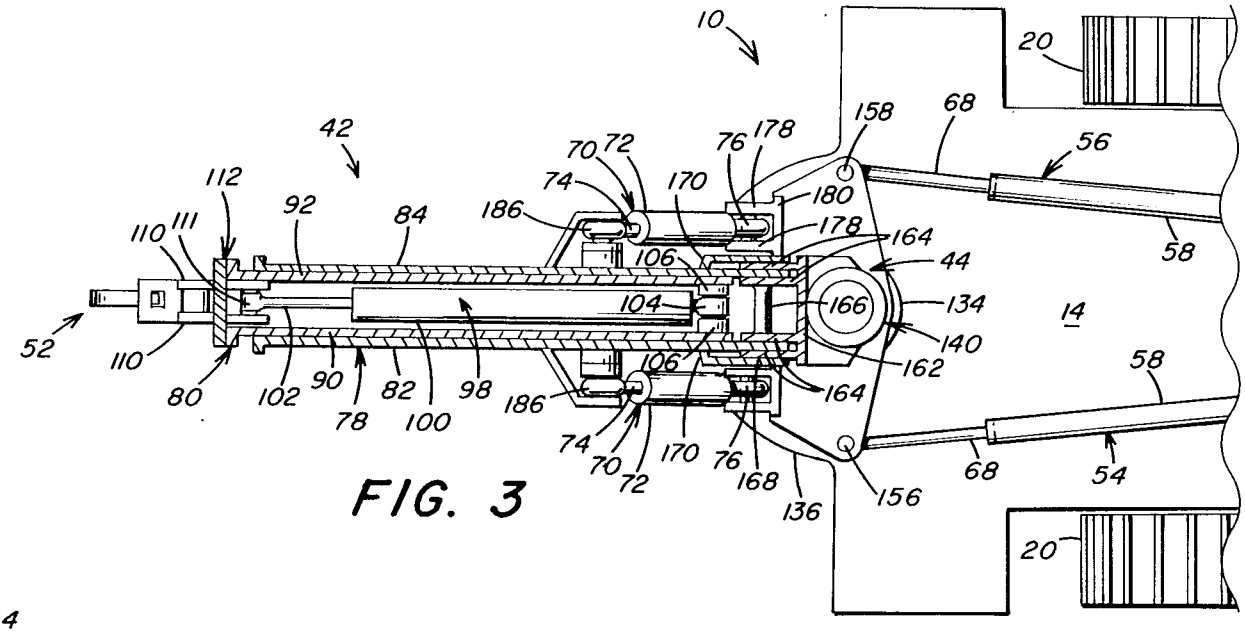
FIG. 3 is a fragmentary, top plan view, partially in section, of the front end of the vehicle, illustrating a piston cylinder assembly housed within the boom assembly which is operable to extend and retract the boom assembly to position the material engaging device a preselected distance from the vehicle.
Figure 4:
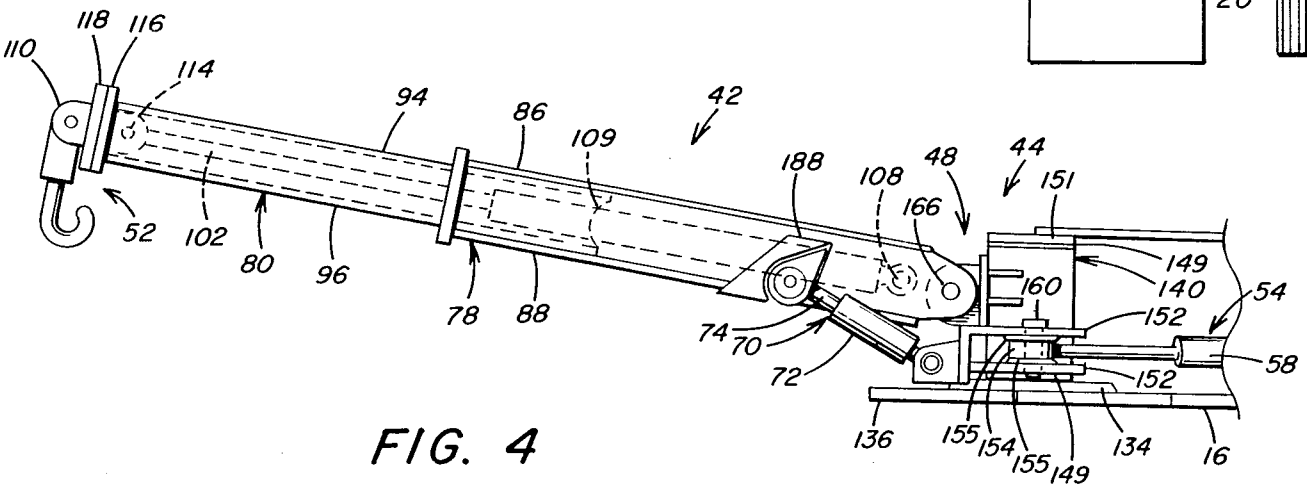
FIG. 4 is a fragmentary view in side elevation of the front end of the vehicle, illustrating in phantom the piston cylinder assembly for extending the boom assembly, and one of the piston cylinder assemblies for raising and lowering the boom assembly vertically relative to the vehicle.

Referring to FIGS. 3 and 4, there is illustrated in greater detail the construction of boom assembly 42 and the construction of support arrangement 44. As seen in FIGS. 3 and 4, the boom assembly 42 includes a first boom member 78 and a second boom member 80. The first boom member 78 has a generally rectangular cross-sectional configuration formed by laterally spaced side plates 82 and 84 which are connected by suitable means, such as welding, to a top plate 86 and a bottom plate 88. The top plate 86 has been removed in FIG. 3 for purposes of illustration. This arrangement forms a hollow interior within first boom member 78 for receiving second boom member 80. Second boom member 80 includes laterally spaced side plates 90 and 92 connected by suitable means to top and bottom plates 94 and 96, respectively. Top plate 94 has also been removed for illustration. The plates 90–96 are arranged to provide second boom member 80 with a rectangular cross-sectional configuration, and the cross-sectional area of second boom member 80 is less than the cross-sectional area formed by the plates of first boom member 78. This permits slidable movement of second boom member 80 relative to first boom member 78 to provide the telescoping feature of the boom assembly 42.

As seen in FIG. 3, the boom assembly second boom member 80 is shown retracted within boom assembly first boom member 78 and the top plates 86 and 94 removed to illustrate a fluid actuated device, such as cylinder assembly 98, positioned within the hollow interior of second boom member 80. Piston cylinder assembly 98 is operable upon actuation to extend and retract second boom member 80 relative to first boom member 78 and thereby change the effective length of boom assembly 42. The cylinder assembly 98 includes a cylinder body 100 and an extensible rod 102. The cylinder body 100 has an end portion 104 with a bore therethrough, and the end portion 104 is aligned with a pair of coaxially positioned bosses 106. The bosses 106 are secured to the inner surfaces of side plates 82, 84 of first boom member 78. A pin number 108 extends through aligned bores in the pair of side plates 82, 84, the bosses 106 and the end portion 104 of cylinder body 100. With this arrangement, the end portion 104 of cylinder assembly 98 is secured for upward and downward pivotal movement with boom assembly 42 first boom member 78.

As seen in FIG. 4, the ends of the side plates 90, 92 of second boom member 80 are provided with arcuate recesses 109. The arcuate recesses 109 permit second boom member 80 to be fully retracted within first boom member 78 without interference from pin member 108 at the inner end of the second boom member 80.

As seen in FIGS. 3 and 4, the outer end of extensible rod 102 of cylinder assembly 98 includes an enlarged end portion 111 having a bore therethrough, which is aligned with bores extending through a pair of lugs 110. The lugs 110 are secured to the boom assembly second boom member 80 at second boom member second end portion 112. A pin 114 extends through aligned bores in extensible rod 102 enlarged end portion 111 and lugs 110 to secure the extensible rob 102 to second boom member 80 second end portion 112. Upon actuation of cylinder assembly 98, extension of the rod 102 from cylinder body 100 extends the second boom member 80 relative to the first boom member 78. Conversely, retraction of piston rod 102 into cylinder body 100 retracts second boom member 80 into first boom member 78. In this manner the boom assembly 42 is adjustable to a preselected overall length.

Figure 6:
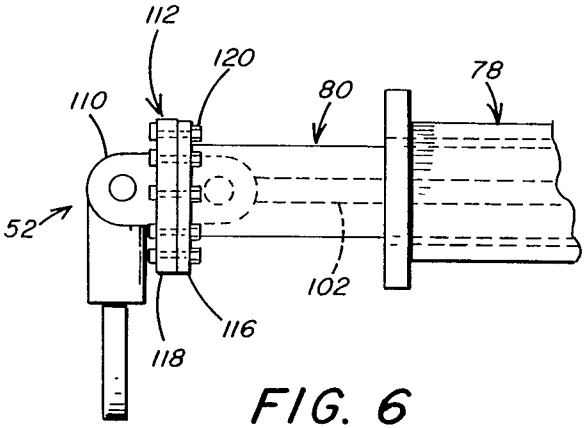
FIG. 6 is a fragmentary view in side elevation of a portion of the boom assembly, illustrating the boom assembly in a retracted position and a hook member secured to the end of the boom assembly.
Figure 7:
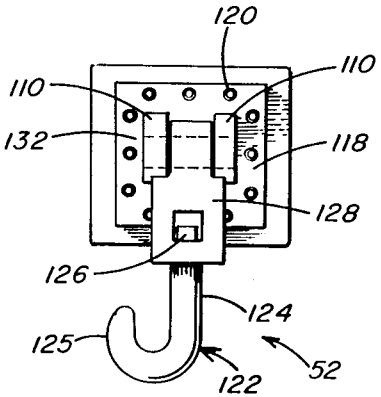
FIG. 7 is an end view of the boom assembly of FIG. 6, illustrating the arrangement for pivotally and rotatably connecting the hook member to the end of the boom assembly.

As illustrated in FIGS. 3 and 4 and in greater detail in FIGS. 6 and 7, the material engaging device generally designated by the numeral 52 is secured to the second end portion 112 of second boom member 80. The outer end of boom assembly 42 second boom member 80 includes a plate member 116 that is suitably secured, such as by welding, to side plates 90, 92 and top and bottom plates 94, 96. The plate member 116 has a rectanglar opening therethrough substantially conforming to the rectangular opening formed by side plates 90, 92 and top and bottom plates 94, 96 of second boom member 80. A plate member 118 is secured by bolts 120 to plate member 116. The pair of lugs 110 extend through aligned slots cut in plate member 118 and are suitably welded thereto to secure the pair of lugs 110 to plate member 118. The end portion of the lugs 110 that extend beyond plate member 118 are connected to the material engaging device 52.

Material engaging device 52 includes a hook member 122 having a shank portion 124 extending upwardly from hooked end 125 with an enlarged end portion 126 at the upper end of the shank 124. The shank 124 extends through a bore of a retainer 128 to permit 360° rotation of the hook member 122. The upper portion of the retainer 128 is pivotally connected by a pin member 132 to the outer end of the pair of lugs 110. The pin member 132 extends through a bore in the upper portion of retainer 128 and the bores of the lugs 110 that extend beyond the plate member 118.

The hook member 122 may be swung upwardly and downwardly about the horizontal axis formed by the pin member 132, as well as rotated about the axis of shank portion 124. This arrangement provides a versatile means by which a number of lifting, pulling and other material handling operations may be performed.

Figure 5:
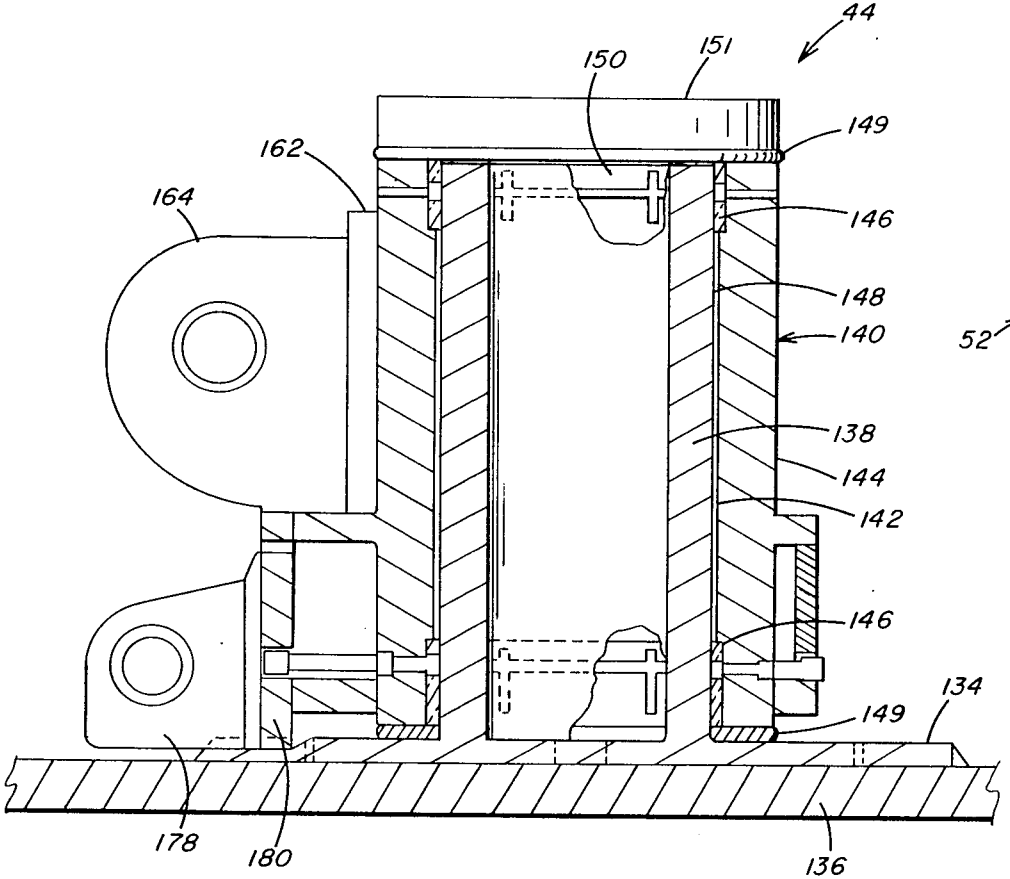
FIG. 5 is a fragmentary side view, partially in section, illustrating the support arrangement positioned at the front end of the vehicle for supporting the boom assembly.

Referring to FIGS. 3 through 5, there is illustrated in further detail the support arrangement 44 and connecting apparatus 48 positioned at the front end 16 of frame 14. As previously described, support arrangement 44 secures boom assembly 42 to underground mining vehicle 10, and is rotated upon simultaneous operation of piston cylinder assemblies 54, 56 to swing boom assembly 42 laterally and position material engaging device 52 at a preselected position to perform various material handling operations.

Support arrangement 44 includes a circular base member 134 secured to frame 14 at frame extension portion 136. Frame extension portion 136 is integral with frame 14 and extends forwardly of the front end 16 of mobile body 12. A support post 138 is secured to circular base member 134 and extends upwardly therefrom. The support post 138 is secured to circular base member 134 by suitable means, such as welding, to prevent support post 138 from rotating relative to circular base member 134. A tubular member 140 having circular inside and outside walls 142, 144, respectively, is positioned for rotational movement in a substantially horizontal plane on support post 138. As seen in FIG. 5, inside wall 142 of tubular member 140 has a diameter larger than the diameter of support post 138, and a pair of bushings 146 are positioned within the hollow interior 148 of tubular member 140 to engage support post 138. Each of the bushings 146 has an inside wall 150 which is scored or grooved in a manner well known in the art to provide lubrication flow paths between support post 138 and the pair of bushings 146.

As seen if FIG. 5, a washer 149, preferably made of brass, is positioned between the bottom circular wall of tubular member 140 and circular base member 134. Washer 149 provides a smooth surface to reduce any frictional forces that may be generated as tubular member 140 is rotated on support post 138. A circular cover plate 151 is secured by suitable means, such as bolting, to the upper end portion of support post 138. Cover plate 151 remains stationary as tubular member 140 is rotated, and circular cover plate 151 prevents tubular member 140 from inadvertently moving vertically on support post 138 as boom assembly 42 is operated. Another washer 149 is positioned between cover plate 151 and the top circular wall of tubular member 140 to reduce the frictional forces generated as tubular member 140 is rotated.

A pair of spaced plate members 152 are secured to the outside wall 144 of tubular member 140. The pair of plate members 152 have substantially the same configuration as illustrated in FIG. 3. Each of the plate members 152 has a generally circular opening larger than the diameter of tubular member 140 outside circular wall 144 to permit the pair of plate members 152 to be positioned a preselected vertical distance from each other on tubular member 140. The pair of plate members 152 are spaced a sufficient vertical distance apart to receive the pair of cylinder assemblies 54, 56 rod end portions 154, which are connected to the outer ends of piston rods 68. The plate members 152 include pairs of aligned openings 156, 158 to receive a pair of pin members 160. As seen in FIGS. 3 and 4, the rod end portions 154 of cylinder assemblies 54, 56 are positioned between the plate members 152, and the rod end portions 154 each include openings aligned with the openings in the plate members 152. Pin members 160 are inserted through the aligned openings in plate members 152 and rod end portions 154 to secure the rod end portions 154 to tubular member 140. As described, the simultaneous operation of cylinder assemblies 54, 56 effects rotational movement of tubular member 140 on support post 138. Since boom assembly 42 is also connected to tubular member 140, it is seen that rotational movement of tubular member 140 effects lateral swinging movement of boom assembly 42 relative to material handling vehicle 10. If desired, a pair of washer members 155 may be secured to plate members 152 as shown in FIG. 4 to eliminate possible vertical movement of the rod end portions 154 of cylinder assemblies 54, 56, and prevent bending of piston rods 68.

FIGS. 3 through 5 further illustrate boom assembly 42 connected to support arrangement 44 by means of connecting apparatus 48. A vertically positioned plate member 162 is secured to the outside wall 144 of tubular member 140. The side plates 84, 86 of first boom member 78 are positioned between pairs of lugs 164, and the lugs and side plates include aligned openings for receiving a pin member 166. A pair of plate members 168 extending between first boom member 78 and plate member 162 each have an end portion 170 secured to the side plates 82, 84 of first boom member 78. Each of the plate members 168 are formed so that a portion of each plate member 168 lies adjacent a lug 164 in each pair of lugs. The plate members 168 also include openings aligned with the openings in the side plates 82, 84 and the lugs 164. The pin member 166 is passed through the aligned openings in plate members 168, lugs 164, and side plates 82, 84 to pivotally connect boom assembly 42 to tubular member 140.

Vertical pivotal movement of boom assembly 42 relative to material handling vehicle 10 is accomplished by a pair of cylinders 70. As previously described, the pair of cylinders 70 are utilized to provide the lifting power required to enable boom assembly 42 to easily lift and maneuver various components presently used in underground mining systems. The pair of cylinders 70 are positioned adjacent the side plates 82, 84 of first boom member 78. Each cylinder 70 has a body portion 72 with a connecting end portion 76 extending therefrom. The connecting end portion 76 of each cylinder 70 is received between a pair of spaced, horizontally extending lugs 178 connected to a vertically positioned plate member 180. the pair of plate members 180 are secured by suitable means to the pair of spaced plate members 152 on tubular member 140. The connecting end portion 76 of each cylinder 70, and the lugs 178 include aligned openings for receiving a pin member. In this manner, the cylinder body portions 72 are connected for vertical pivotal movement to tubular member 140. Each pivoting cylinder 70 also includes an extensible rod portion 74 and a connecting end portion 186 secured to the outer end of extensible rod portion 74. The connecting end portions 186 of the pair of cylinders 70 are connected for vertical pivotal movement to the side plates 82, 84 of first boom member 78. Although not specifically shown in the Figures, the connecting end portion 186 of each cylinder 70 has an opening therethrough for receiving a pin member which is secured to side plates 82, 84 respectively. If desired, the connecting end portion 186 of each cylinder 70 may be covered by a shroud 188 as illustrated in FIG. 2 (one shown). It should be understood that if a covering or shroud such as shroud 188 is employed to protect the connection between cylinder 70 connecting end portion 186 and first boom member 78, the shroud must have a configuration which permits the connecting end portion 186 to pivot freely as the pair of cylinders 70 are actuated to effect vertical pivotal movement of boom assembly 42.

The pair of cylinders 70 positioned longitudinally at the sides of boom assembly 42 are operable to effect vertical pivotal movement of boom assembly 42 at the front end 16 of frame 14. If it is desired to raise boom assembly 42 in an upward arcuate path relative to material handling vehicle 10, the extensible rod portions 74 of the pair of cylinders 70 are extended from cylinder body portions 72. Conversely, if it is desired to lower boom assembly 42 in a downward vertical path relative to material handling vehicle 10, the extensible rod portions 74 of the pair of cylinders 70 are retracted into the cylinder body portions 72.

As described, retraction of the pair of extensible rod portions 74 into the pair of cylinder body portions 72 pivots the entire boom assembly 42 downwardly about pin member 166 to thereby lower the hook member 122 connected to second boom member 80 second end portion 112. Raising the boom assembly 42 is accomplished by extending the pair of extensible rod portions 74 from the pair of pivoting cylinder body portions 72. As seen, the upward and downward pivotal movement of boom assembly 42 is accomplished independently of the lateral swinging movement of boom assembly 42. In this manner, the hook member 122 is selectively positioned at a preselected elevation and at a preselected lateral position relative to the mobile body 12. In addition, the pair of cylinders 70 provide the lifting power required to allow a piece of equipment to be easily lifted by boom assembly 42 and hook member 122 and transported or maneuvered as required.

Thus, the boom assembly 42 is safely and efficiently operated to position the hook member 122 for engaging a piece of equipment to be handled. Movement of the equipment is accomplished by tramming the vehicle 10, and the vehicle operator, positioned at operators station 32, has a clear veiw of the equipment to control its movement in a safe manner through the mine.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A material handling vehicle for use in a mine comprising, a mobile body, ground engaging traction means connected to said mobile body for propelling said mobile body in a mine along a floor of said mine, a boom assembly extending from said mobile body, said boom assembly having a first end portion adjacent said mobile body and a second end portion spaced from said first end portion, a support post secured to said mobile body and extending upwardly therefrom, a tubular member surrounding said support post, said tubular member being connected to said support post for rotational movement relative to said support post, said boom assembly first end portion being connected to said tubular member for vertical pivotal movement relative to said tubular member, first actuating means mounted on said mobile body and connected to said tubular member, said first actuating means being operable to rotate said tubular member relative to said support post, first connecting means for securing said boom assembly first end portion to said tubular member to permit said vertical pivotal movement of said boom assembly first end portion relative to said tubular member, a pair of second actuating means for pivoting said boom assembly first end portion in a vertical path relative to said tubular member, each said second actuating means positioned laterally of a longitudinal axis of said boom assembly, one said second actuating means positioned laterally of said boom assembly first end portion with an end portion of said second actuating means connected for pivotal movement to said tubular member and an opposite end portion of said second actuating means pivotally received on a pivot pin fixed to a first side wall portion of said boom assembly first end portion, said pivot pin being located further out on said boom assembly from said mobile body than the connection of said second actuating means to said tubular member, another said second actuating means positioned laterally of said boom assembly first end portion with an end portion of said second actuating means connected for pivotal movement to said tubular member and an opposite end portion of said second actuating means pivotally received on a pivot pin fixed to a second side wall portion of said boom assembly first end portion, said pivot pin being located further out on said boom assembly from said mobile body than the connection of said second actuating means to said tubular member, said pair of second actuating means operable to effect said vertical pivotal movement of said boom assembly first end portion independently of the rotational movement of said tubular member relative to said support post, extensible means for extending and retracting said boom assembly second end portion relative to said boom assembly first end portion, said extensible means having an end portion connected to said boom assembly first end portion and an opposite end portion connected to said boom assembly second end portion, and material engaging means connected to said boom assembly second end portion for engaging material to be lifted and moved by said boom assembly.

2. A material handling vehicle for use in a mine as set forth in claim 1 in which, said mobile body has a front end portion and a rear end portion with a frame member extending between said front end portion and said rear end portion.

said frame member includes a frame extension portion which projects forwardly of said mobile body front end portion, said support post is positioned on said frame member frame extension portion and extends upwardly therefrom for receiving said tubular member, and said boom assembly first end portion is connected to said tubular member for lateral swinging movement of said boom assembly forwardly of said frame member frame extension portion upon rotation of said tubular member.

3. A material handling vehicle for use in a mine as set forth in claim 1 in which, said boom assembly includes a first elongated boom member connected to said tubular member for lateral swinging movement relative to said mobile body upon rotation of said tubular member by said first actuating means, said boom assembly including a second elongated boom member telescopically supported by said first boom member, and said second boom member being arranged to extend and retract relative to said first boom member upon actuation of said extensible means to thereby change the effective length of said boom assembly.

4. A material handling vehicle for use in a mine as set forth in claim 1 in which, said boom assembly includes a first boom member and a second boom member, said second boom member being longitudinally movable relative to said first boom member for extending said boom assembly to a preselected length, said first boom member being connected to said tubular member for vertical pivotal movement about a horizontal axis to effect upward and downward movement of said boom assembly to position a material engaging means connected to an end portion of said second boom member at a preselected elevation relative to said mobile body, each of said pair of second actuating means being connected at one end to said tubular member and at an opposite end to a side wall portion of said first boom member, and said pair of second actuating means being operable to raise and lower said first and second boom members in a vertical arcuate path.

5. A material handling vehicle for use in a mine as set forth in claim 1 in which, said boom assembly includes a first boom member and a second boom member, said first boom member being connected to said tubular member for upward and downward pivotal movement relative thereto, said second boom member having one end portion slidably supported by said first boom member and an opposite end portion extending from said first boom member, said extensible means connected at one end to said first boom member and at the opposite end to said second boom member opposite end portion, and said extensible means being operable to extend and retract said second boom member relative to said first boom member and there by change the effective length of said boom assembly.

6. A material handling vehicle for use in a mine as set forth in claim 1 in which, said tubular member includes a pair of spaced plate members positioned substantially horizontally and extending laterally of said tubular member, said first actuating means includes a pair of cylinder means positioned longitudinally on said mobile body, each said cylinder means having an end portion connected to said mobile body and an opposite end portion positioned between and connected to said pair of spaced plate members, and said pair of cylinder means being operable upon actuation to rotate said tubular member on said support post and thereby swing said boom assembly connected to said tubular member laterally relative to said mobile body.

7. A material handling vehicle for use in a mine as set forth in claim 1 in which, said boom assembly includes a first boom member pivotally connected to said tubular member, said first boom member having a hollow interior portion, said boom assembly includes a second boom member having a hollow interior portion, a portion of said second boom member positioned within said first boom member hollow interior portion and a portion of said second boom member extending from said first boom member, and said extensible means being positioned within said second boom member hollow interior portion with an end portion of said extensible means connected to said first boom member and an opposite end portion of said extensible means connected to said second boom member.

8. A material handling vehicle for use in a mine as set forth in claim 1 in which, said boom assembly includes a first boom member pivotally connected to said tubular member and a second boom member telescopically supported by said first boom member, said second boom member having an end portion positioned within a hollow interior portion of said first boom member and a second end portion spaced from said first boom member, material engaging means being connected to said second boom member second end portion for engaging material to be lifted and moved by said boom assembly, said material engaging means including a hook member having an elongated shank and a hooked end portion, retainer means pivotally connected to said second boom member second end portion for upward and downward pivotal movement about a horizontal axis, and said retainer means having an opening therethrough for rotatably receiving said hook member elongated shank, said retainer means connecting said hook member to said second boom member second end portion.

* * * * *